United States Patent [19]

Shimizu et al.

[11] 4,414,078

[45] Nov. 8, 1983

[54] METHOD FOR PRETREATMENT IN THE PRODUCTION OF TIN-FREE STEEL

[75] Inventors: Nobuyoshi Shimizu; Kinji Saijo; Kenji Hizuka, all of Kudamatsu; Tsuneo Inui, Tokuyama; Yoshikazu Kondo, Kudamatsu, all of Japan

[73] Assignee: Toyo Kohan Company, Limited, Tokyo, Japan

[21] Appl. No.: 357,665

[22] Filed: Mar. 12, 1982

Related U.S. Application Data

[63] Continuation of Ser. No. 141,210, Apr. 17, 1980, abandoned.

[30] Foreign Application Priority Data

Aug. 9, 1979 [JP] Japan ..... 54-100723

[51] Int. Cl.[3] ..... C25D 5/36

[52] U.S. Cl. ..... 204/34; 204/41; 204/56 R

[58] Field of Search ..... 204/34, 35 R, 35 N, 204/41, 56 R

[56] References Cited

U.S. PATENT DOCUMENTS

| | | | |
|---|---|---|---|
| 3,075,897 | 1/1963 | Higgs | 204/42 |
| 3,567,599 | 3/1971 | Carter et al. | 204/41 |
| 3,642,586 | 2/1972 | Shepard | 204/34 |
| 3,799,814 | 3/1974 | Yamagishi et al. | 148/6.2 |
| 4,157,944 | 6/1979 | Inui | 204/41 |

FOREIGN PATENT DOCUMENTS

| | | | |
|---|---|---|---|
| 597567 | 1/1948 | United Kingdom | 204/34 |

*Primary Examiner*—G. L. Kaplan
*Assistant Examiner*—William Leader
*Attorney, Agent, or Firm*—Wenderoth, Lind & Ponack

[57] ABSTRACT

A method for the pretreatment of tin-free steel which comprises an anodic treatment or an anodic treatment after a cathodic treatment of an acid pickled steel sheet in an alkaline electrolyte with a pH of above 8, said steel sheet consisting of an upper layer of hydrated chromium oxide and a lower layer of metallic chromium. This pretreated tin-free steel has excellent lacquer adhesion after aging in hot water and under retort conditions.

9 Claims, 1 Drawing Figure

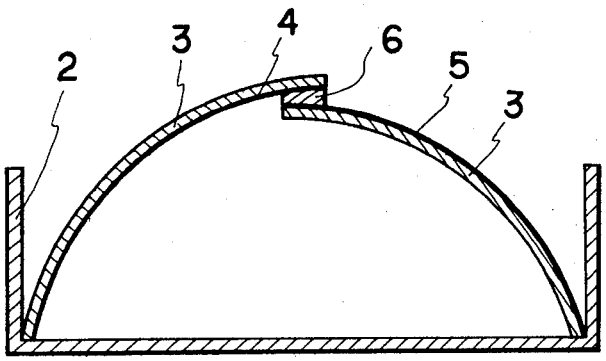
2
3
4
6
5
3

METHOD FOR PRETREATMENT IN THE PRODUCTION OF TIN-FREE STEEL

CROSS-REFERENCE TO RELATED APPLICATION

This is a continuation application of application Ser. No. 141,210, filed Apr. 17, 1980, now abandoned.

BACKGROUND OF THE INVENTION

The present invention relates to a pretreatment method in a manufacturing process of a tin-free steel (TFS) having a first layer of metallic chromium on a steel base, and a second layer of hydrated chromium oxide on the first layer.

DESCRIPTION OF THE PRIOR ART

Recently, lacquered TFS has largely been used for manufacturing carbonated beverage cans and beer cans, since it exhibits excellent lacquer adhesion. In the case of lacquered TFS, the seaming of the can body is mainly carried out with a nylon adhesive. The adhered part of the lacquered TFS can body not only has an acceptable bonding strength at a normal temperature, but also has a bonding strength which can satisfactorily withstand internal pressure caused by the contents, such as beer and carbonated beverages.

However, when a can having a TFS can body seamed by a nylon adhesive after lacquering is used as a container for foods such as fruit juices which are immediately hot-packed after pasteurization at a temperature of 90°–100° C., or as a container for foods such as coffee, meat and fish, which are pasteurized by hot steam at a temperature above 100° C. in a retort after being packed in the can, the lacquer film may be peeled off from the TFS surface. Thus, a drop in the degree of vacuum in the can may occur due to the partial loss of adhesion in the adhered parts of the can body, because the lacquer adhesion of conventional TFS becomes poor after aging in hot water and under retort conditions. Therefore, it is not possible to use conventional TFS cans seamed with nylon adhesive after lacquering, for pasteurizing the contents of the cans packed at high temperature.

Recently, methods to provide TFS having an excellent lacquer adhesion after aging in hot water and under retort conditions have been proposed by us. One method relates to a pretreatment which is characterized by a cathodic treatment after an anodic treatment of said steel sheet in an acidic chromate electrolyte prior to conventional electrolytic chromic acid treatment. Another method relates to a composition of hydrated chromium oxide in TFS which is characterized by the restriction in the amount of sulfur and fluorine incorporated in the hydrated chromium oxide layer or by the restriction in the amount of oxygen existing as a hydroxyl radical and bonded water (water bonded to trivalent chromium) in the hydrated chromium oxide layer.

SUMMARY OF THE INVENTION

It is an object of the present invention to provide TFS having an excellent lacquer adhesion after aging in hot water and under retort conditions by an improvement in the pretreatment of the TFS.

In the present invention, the steel sheet is subjected to an anodic treatment or an anodic treatment after a cathodic treatment in an alkaline electrolyte having a pH of above 8, after degreasing by an alkaline solution and pickling by sulfuric acid or hydrochloric acid. The steel sheet is then subjected to the conventional electrolytic chromic acid treatment.

The alkaline electrolyte having a pH above 8 used for the pretreatment according to the present invention contains at least one alkaline compound selected from the group consisting of a hydroxide, a carbonate, a bicarbonate, a silicate and a borate of an alkali metal and ammonium, or furthermore contains at least one compound selected from the group consisting of a phosphate, an acidic phosphate, an oxalate and an acetate of an alkali metal and ammonium.

Generally, the amount of metallic chromium is in the range of 50–150 mg/m$^2$ and that of hydrated chromium oxide is in the range of 8–25 mg/m$^2$ as chromium in TFS, namely the thickness of metallic chromium is about 70–210 Å and that of hydrated chromium oxide is about 70–220 Å. In consideration of the roughness of the surface of the steel sheet, these are very thin films.

Furthermore, the growth of metallic chromium depends strongly on the crystallographic orientation in the surface of the steel sheet because the crystal structure of metallic chromium is the same body centered cubic lattice as that of iron and the lattice constants of those are very close, that is, 2.884 Å in metallic chromium and 2.866 Å in iron. The rate of crystal growth of metallic chromium is also different by the crystallographic orientation of steel.

Accordingly, the thickness of the metallic chromium layer which is deposited by an electrolytic chromic acid treatment, differs depending on the crystallographic orientation of the individual steel and the thickness of the hydrated chromium oxide layer formed on the metallic chromium layer also varies with the effect of the crystallographic orientation of the steel base. Therefore it is considered that the distribution in the thickness of the metallic chromium layer and hydrated chromium oxide layer becomes nonuniform.

Especially, it is considered that a nonuniform TFS film is formed in the case of the conventional process of manufacturing TFS. Such conventional process comprises a series of degreasing by an alkaline solution, pickling by a sulfuric acid solution, rinsing with water and an electrolytic chromic acid treatment. The effect of the crystallographic orientation of the steel base is magnified by pickling because the surface of the steel base is activated.

On the other hand, a uniform TFS film consisting of metallic chromium and hydrated chromium oxide can be formed by an electrolytic chromic acid treatment as a result of the pretreatment according to the present invention. This is presumed to be because the effects of the crystallographic orientation of the steel base are reduced by the pretreatment according to the present invention, in which the surface of the steel base activated by pickling is inactivated by an anodic treatment in an alkaline electrolyte.

Although it may be considered that the pretreatment according to the present invention is the same process as that of the conventional process, in which pickling is omitted, there is a clear difference in uniformity of surface oxide films. Pickling is necessary in the present invention because the nonuniform oxide film, formed in the annealing process or the other process cannot be removed sufficiently and uniformly the first conventional alkaline degreasing.

In the present invention, it is important that the surface of the steel base is inactivated uniformly by an anodic treatment in an alkaline electrolyte after the nonuniform oxide film formed on the steel base in the annealing process is sufficiently removed by pickling.

Although a cathodic treatment or a cathodic treatment after an anodic treatment in an alkaline electrolyte has been considered, TFS having an excellent lacquer adhesion after aging in hot water and under retort conditions, which is the object of the present invention, cannot be obtained. This is becasue the surface of the steel base activated by pickling is not inactivated by a cathodic treatment in an alkaline electrolyte and the surface of the steel base, inactivated by an anodic treatment, is activated again by a cathodic treatment in an alkaline electrolyte since the oxide film on the steel base is reduced by the cathodic treatment.

As described above, in the present invention, the uniformities of a metallic chromium layer and a hydrated chromium oxide layer in TFS are important factors influencing the lacquer adhesion after aging in hot water and under retort conditions, which is the object of the present invention. The uniformities of a metallic chromium layer and a hydrated chromium oxide layer are improved by the pretreatment according to the present invention.

BRIEF DESCRIPTION OF THE DRAWING

The FIGURE shows a brief cross-section, which represents a testing method of the lacquer adhesion of a TFS specimen under retort conditions.

After one piece of TFS 3 having a thick lacquer film of an epoxy-phenolic type 4, and another piece of TFS 3 having a thin lacquer film of an epoxy-phenolic type 5 are adhered with a nylon adhesive 6 on the edges, the resultant adhered specimen is fixed in the channel 2 in a bent state as shown in the FIGURE.

DETAILED DESCRIPTION OF THE INVENTION

In general, two types of manufacturing processes are well known for the production of conventional TFS. Namely, one is a one-step process in which metallic chromium and hydrated chromium oxide are simultaneously formed by using one electrolyte. The other is a two step process in which metallic chromium is formed at first using a chromium plating solution and then hydrated chromium oxide is formed on the metallic chromium layer by using other electrolytes.

The pretreatment step of the present invention is applicable to both the one-step and two-step processes and can improve the lacquer adhesion of TFS after aging in hot water and under retort conditions.

It is an essential condition that the alkaline electrolyte used for the pretreatment of the present invention should be maintained above a pH of 8, although it is not necessary to strictly control the concentration of hydroxide, carbonate etc., salts of the alkali metal and ammonium radical.

The concentration of the alkaline electrolyte is preferably in the range of 10–100 g/l, if they are restricted.

If the concentration of the alkaline electrolyte used for the present invention is below 10 g/l, a waste of electric power results because of the higher electric resistance of the alkaline electrolyte. The concentration is limited to 100 g/l from the economical point of view, although the effect of the present invention is not reduced if the concentration is above 100 g/l. The concentration of the phosphate, acidic phosphate, oxalate and acetate of the alkali metal and ammonium radical added to the alkaline electrolyte is also desirably in the range of 10–100 g/l and in this case, the pH of the alkaline electrolyte should be still maintained above 8.

In the case of an acidic or weakly alkaline electrolyte below a pH of 8, the effect of the present invention cannot be accomplished, because the surface of the steel base is not inactivated.

The effect of the present invention is not reduced as far as the alkaline electrolyte according to the present invention is maintained above a pH of 8, even if a small amount of sulfuric acid or hydrochloric acid is brought into the alkaline electrolyte of the present invention because of insufficient rinsing after pickling. Furthermore, the effect of the present invention is not reduced, even if the surface active agent, which is usually added to the alkaline solution for degreasing of the steel sheet, is added to the alkaline electrolyte according to the present invention. Although it is not necessary that the temperature of the electrolyte used for the pretreatment of the present invention be strictly controlled, it is preferably below 90° C. from an energy savings point of view.

The manner in which the electrolytic treatment is carried out is most important in the present invention. Namely electrolytic treatment must be either anodic or anodic after cathodic.

It is necessary to accomplish the object of the present invention that the quantity of electricity for the anodic treatment be in the range of 1–200 coulombs/dm$^2$, more preferably in the range of 5–50 coulombs/dm$^2$. If the quantity of electricity is below 1 coulomb/dm$^2$, the effect of the present invention is not obtained because the inactive dense oxide film is not uniformly formed on the surface of the steel base.

The use of a quantity of electricity above 200 coulombs/dm$^2$ is not desirable in the present invention, because the inactive oxide film formed on the surface of the steel base is not reduced or removed sufficiently by the following electrolytic chromic acid treatment and may induce a surface stain.

For the high speed production of TFS, it is reasonable that the electrolytic time is 0.1–5 seconds, and the range of the current density is 1–100 A/dm$^2$ in the anodic treatment of the pretreatment.

In the case of an anodic treatment after a cathodic treatment, it is not necessary to control strictly the conditions of cathodic treatment since a cathodic treatment prior to an anodic treatment has less effect on the formation of inactivated oxide film. However, it is naturally limited from the point of the high speed production of TFS.

From an industrial point of view, the application of the following methods has been considered in conjunction with the pretreatment of the present invention, and it has been discovered that the effect of the present invention does not change by use of these methods. The first is a method in which the cycle consisting of the anodic treatment after the cathodic treatment is repeated several times. The second is a method in which water rinsing is carried out between the cathodic treatment and the following anodic treatment.

It is needless to say that the pretreatment according to the present invention is applicable not only to the electrolytic chromic acid treatment, but also to the metal plating of the steel sheet in which the uniformity and the denseness of the metal layer is required.

The present invention is illustrated by the following examples, in which a duplex layer consisting of a lower layer of metallic chromium in the amount of 80–120 mg/m$^2$ and an upper layer of hydrated chromium oxide in the amount of 12–20 mg/m$^2$ as chromium is formed on a cold rolled steel sheet having a thickness of 0.23 mm under various conditions of electrolytic chromic acid treatment.

EXAMPLE 1

A cold rolled steel sheet was electrolytically degreased in a solution of 70 g/l sodium hydroxide. After rinsing with water, the steel sheet was pickled by immersion into a solution of 100 g/l sulfuric acid. After rinsing with water, the steel sheet was pretreated under the following conditions.

| Conditions of Pretreatment | |
|---|---|
| Composition of electrolyte | |
| Sodium hydroxide | 60 g/l |
| pH of electrolyte | 14 |
| Temperature of electrolyte | 30° C. |
| Anodic current density | 20 A/dm$^2$ |
| Anodic treating time | 1 sec. |

After rinsing with water, the pretreated steel sheet was subjected to electrolytic chromic acid treatment under the following conditions and was then rinsed with hot water and dried.

| Conditions of Electrolytic Chromic Acid Treatment | |
|---|---|
| Composition of electrolyte | |
| Chromic trioxide | 50 g/l |
| Sodium fluoride | 3 g/l |
| Temperature of electrolyte | 50° C. |
| Cathodic current density | 20 A/dm$^2$ |

EXAMPLE 2

The same kind of steel sheet degreased and pickled as in Example 1 was pretreated under the following conditions after rinsing with water.

| Conditions of Pretreatment | |
|---|---|
| Composition of electrolyte | |
| Sodium orthosilicate | 30 g/l |
| pH of electrolyte | 14 |
| Temperature of electrolyte | 80° C. |
| Anodic current density | 30 A/dm$^2$ |
| Anodic treating time | 2 sec. |

After rinsing with water, the pretreated steel sheet was subjected to electrolytic chromic acid treatment under the following conditions and was then rinsed with hot water and dried.

| Conditions of Electrolytic Chromic Acid Treatment | |
|---|---|
| Composition of electrolyte | |
| Chromic trioxide | 30 g/l |
| Ammonium fluoride | 1.5 g/l |
| Temperature of electrolyte | 30° C. |
| Cathodic current density | 20 A/dm$^2$ |

EXAMPLE 3

The same kind of steel sheet degreased and pickled as in Example 1 was pretreated under the following conditions after rinsing with water.

| Conditions of Pretreatment | |
|---|---|
| Composition of electrolyte | |
| Sodium hydroxide | 8 g/l |
| Sodium phosphate | 30 g/l |
| pH of electrolyte | 10 |
| Temperature of electrolyte | 60° C. |
| Electrolytic method | |
| Anodic treatment after cathodic treatment | |
| Anodic and cathodic current density | Each 5 A/dm$^2$ |
| Anodic and cathodic treating time | Each 1 sec. |

After rinsing with water, the pretreated steel sheet was plated with metallic chromium by using an electrolyte containing 250 g/l of chromium trioxide and 2.5 g/l of sulfuric acid in water under 30 A/dm$^2$ of cathodic current density at an electrolyte temperature of 50° C. After rinsing with water, the chromium plated steel sheet was subjected to electrolytic chromic acid treatment under the following conditions and was then rinsed with hot water and dried.

| Conditions of Electrolytic Chromic Acid Treatment | |
|---|---|
| Composition of electrolyte | |
| Chromic trioxide | 30 g/l |
| Sulfuric acid | 0.2 g/l |
| Sodium fluoride | 1.0 g/l |
| Temperature of electrolyte | 30° C. |
| Cathodic current density | 20 A/dm$^2$ |

EXAMPLE 4

The same kind of steel sheet degreased and pickled as in Example 1 was pretreated under the following conditions after rinsing with water.

| Conditions of Pretreatment | |
|---|---|
| Composition of electrolyte | |
| Sodium borate | 15 g/l |
| Potassium hydroxide | 20 g/l |
| pH of electrolyte | 13.5 |
| Temperature of electrolyte | 60° C. |
| Anodic current density | 10 A/dm$^2$ |
| Anodic treating time | 2 sec. |

After rinsing with water, the pretreated steel sheet was treated by using an electrolyte containing 90 g/l of chromic trioxide and 6 g/l of sodium fluoride in water under 40 A/dm$^2$ of cathodic current density at an electrolyte temperature of 50° C. The treated steel sheet was then further treated with this electrolyte diluted to one-third its original concentration under 10 A/dm$^2$ of cathodic current density at an electrolyte temperature of 35° C., and was then rinsed with hot water and dried.

As comparative examples, the same kind of steel sheet was degreased and pickled as in Example 1. After rinsing with water, Comparative examples 1, 2, 3 and 4 were subjected to electrolytic chromic acid treatment or electrolytic chromic acid treatment after chromium plating under the same conditions as in Examples 1, 2, 3 and 4, respectively, without the pretreatment according to the present invention, and were then rinsed with hot water and dried.

The amount of metallic chromium and hydrated chromium oxide as chromium in TFS which was prepared in Examples 1, 2, 3 and 4 and in Comparative examples 1, 2, 3 and 4 was measured and the characteristics of each resulting TFS were evaluated by the following test methods, the results of which are shown in the Table 1.

(1) Lacquer adhesion at a normal temperature.

Two pieces of the treated sample were prepared. One piece of the treated sample was baked at 210° C. for 12 minutes after coating with 60 mg/dm$^2$ of an epoxy-phenolic type lacquer and the other piece was baked two times under the same conditions as described above, before and after coating with 25 mg/dm$^2$ of the same lacquer.

The two differently coated sample pieces were each cut to a size of 5 mm×100 mm and bonded together using a nylon adhesive having a thickness of 100 μm at 200° C. for 30 seconds under 3 kg/cm$^2$ of pressure by a Hot Press after preheating at 200° C. for 120 seconds.

The bonding strength of the assembly which is shown as kg/5 mm was measured by a conventional tensile testing machine.

(2) Lacquer adhesion after aging in hot water.

The assembly prepared by the method described in (1) above, was peeled by a conventional tensile testing machine after the assembly was immersed in a 0.4% citric acid solution at 90° C. for 3 days. The bonding strength of the assembly was shown as kg/5 mm.

(3) Lacquer adhesion under retort conditions.

Two pieces of the differently coated samples prepared by the method described in (1) above, were each cut to a size of 70 mm width and 60 mm length, respectively, and were bonded in such a way as to overlap each other by 8 mm in a longitudinal direction under the same conditions as described in (1).

Ten assembled samples were prepared as described above.

Each assembled sample was curled to a radius of 100 mm as for a can body, and then fixed in a channel of 70 mm width.

After that, the ten fixed samples were set in a retort in which hot steam, heated to 125°–130° C. under a pressure of 1.6–1.7 kg/cm$^2$, was blown for 150 minutes or for 300 minutes. The lacquer adhesion under retort conditions was evaluated by the number of the samples which had peeled to the total ten assembled samples.

As shown in Table 1, it is evident that there are very clear differences between the Examples of the present invention and the Comparative examples in the lacquer adhesion after aging in hot water and under retort conditions, although there is no difference between the Examples of the present invention and the Comparative examples in the lacquer adhesion at a normal temperature. It is recognized from these Examples that the pretreatment of the present invention has the remarkable effect of improving the lacquer adhesion after aging in hot water and under retort conditions.

TABLE 1

CHARACTERISTICS OF TREATED STEEL SHEET

| | | Example | | | | Comparative Example | | | |
|---|---|---|---|---|---|---|---|---|---|
| | | 1 | 2 | 3 | 4 | 1 | 2 | 3 | 4 |
| Amount of metallic Cr in mg/m$^2$ | | 112 | 115 | 106 | 110 | 115 | 122 | 100 | 108 |
| Amount of hydrated Cr oxide (as Cr) in mg/m$^2$ | | 16 | 15 | 14 | 18 | 15 | 13 | 17 | 18 |
| Lacquer adhesion at a normal temperature (kg/5 mm) | | 6.8 | 6.2 | 6.4 | 6.6 | 6.7 | 6.4 | 6.3 | 6.6 |
| Lacquer adhesion after aging in hot water (kg/5 mm) | | 3.2 | 3.1 | 2.8 | 3.0 | 1.8 | 1.5 | 0.9 | 1.3 |
| Lacquer adhesion under retort conditions (A/B)* | 150 min. | 0/10 | 0/10 | 0/10 | 0/10 | 1/10 | 0/10 | 0/10 | 0/10 |
| | 300 min. | 0/10 | 1/10 | 3/10 | 1/10 | 7/10 | 8/10 | 10/10 | 7/10 |

*A shows the number of the peeled assembly. B shows the total number of the assembly.

What is claimed is:

1. A method for pretreating a steel substrate prior to formation of a tin-free steel which comprises pickling the steel substrate with sulfuric or hydrochloric acid to activate the surface of the steel substrate; subjecting the thus-pickled steel substrate to an anodic treatment or an anodic treatment after a cathodic treatment, said anodic treatment being conducted in an alkaline electrolyte containing a member selected from the group consisting of an alkali metal compound, an ammonium compound or mixtures thereof having a pH of above 8, and then subjecting the thus-pretreated steel substrate to an electrolytic chromic acid treatment to produce a tin-free steel by forming a lower layer of metallic chromium in the range of 50–150 mg/m$^2$ and an upper layer of hydrated chromium oxide in the range of 8–25 mg/m$^2$ as chromium.

2. A method according to claim 1, wherein the alkaline electrolyte is an alkali metal compound consisting of at least one compound selected from the group consisting of a hydroxide, a carbonate, a bicarbonate, a silicate and a borate of an alkali metal.

3. A method according to claim 1, wherein the alkaline electrolyte is an ammonium compound consisting of at least one compound selected from the group consisting of a hydroxide, a carbonate, a bicarbonate, a silicate and a borate of ammonium.

4. A method according to claims 2 or 3, wherein the concentration of the electrolyte is 10–100 g/l.

5. A method according to claim 1, wherein an additive consisting of at least one compound selected from the group consisting of a phosphate, an acidic phosphate, an oxalate and an acetate of an alkali metal or ammonium is added to the alkaline electrolyte.

6. A method according to claim 5 wherein the concentration of said additive is 10–100 g/l.

7. A method according to claim 1, wherein the anodic treatment is carried out at 1–200 coulomb/$dm^2$.

8. A method according to claim 1, wherein the anodic treatment is carried out at a temperature below 90° C. and a current density of 1–100 A/$dm^2$ for 0.1–5 seconds.

9. A method according to claim 1, in which the thickness of the metallic chromium layer is about 70–210 Å and that of the hydrated chromium oxide is about 70–220 Å.

* * * * *